US010825605B2

(12) United States Patent
Wang et al.

(10) Patent No.: US 10,825,605 B2
(45) Date of Patent: Nov. 3, 2020

(54) TRANSFORMER

(71) Applicant: FUJI ELECTRIC CO., LTD., Kanagawa (JP)

(72) Inventors: Qichen Wang, Tokyo (JP); Satoru Fujita, Tokyo (JP)

(73) Assignee: FUJI ELECTRIC CO., LTD., Kawasaki-shi, Kanagawa (JP)

( * ) Notice: Subject to any disclaimer, the term of this patent is extended or adjusted under 35 U.S.C. 154(b) by 307 days.

(21) Appl. No.: 16/111,717

(22) Filed: Aug. 24, 2018

(65) Prior Publication Data

US 2019/0131062 A1 May 2, 2019

(30) Foreign Application Priority Data

Oct. 26, 2017 (JP) ..... 2017-207291

(51) Int. Cl.

| | |
|---|---|
| ***H01F 27/28*** | (2006.01) |
| ***H01F 27/34*** | (2006.01) |
| ***H01F 27/24*** | (2006.01) |
| ***H01F 27/00*** | (2006.01) |
| *H01F 27/06* | (2006.01) |

(52) U.S. Cl.

CPC ..... *H01F 27/346* (2013.01); *H01F 27/006* (2013.01); *H01F 27/24* (2013.01); *H01F 27/28* (2013.01); *H01F 2027/065* (2013.01)

(58) Field of Classification Search

CPC ..... H01F 5/06; H01F 27/346; H01F 27/24; H01F 27/28; H01F 27/006; H01F 27/2823; H01F 27/2847; H01F 27/2866; H01F 27/32; H01F 27/323; H01F 2027/065

USPC ..... 336/147, 170, 198, 208, 212, 220–222

See application file for complete search history.

(56) References Cited

U.S. PATENT DOCUMENTS

| | | | | |
|---|---|---|---|---|
| 7,777,570 | B2 * | 8/2010 | Lai | H04B 1/0483 330/276 |
| 9,349,521 | B2 * | 5/2016 | Tsai | H01F 27/2847 |
| 2008/0284551 | A1 * | 11/2008 | Chen | H01F 27/2866 336/182 |
| 2010/0026437 | A1 * | 2/2010 | Lin | H01F 27/2847 336/192 |
| 2011/0115598 | A1 * | 5/2011 | Wu | H01F 27/325 336/212 |
| 2015/0318098 | A1 * | 11/2015 | Miyamoto | H01F 5/02 336/183 |

(Continued)

FOREIGN PATENT DOCUMENTS

JP 2006-013094 1/2006

*Primary Examiner* — Mang Tin Bik Lian
(74) *Attorney, Agent, or Firm* — IPUSA, PLLC

(57) ABSTRACT

A transformer includes: a core having a shaft; primary windings; and secondary windings around the shaft alternately with the primary windings. A first number of turns of a first secondary winding, closest to a first end of the shaft, is less than a second number of turns of a second secondary winding, second closest to the first end. A third number of turns of a third secondary winding, closest to a second end of the shaft, is less than a fourth number of turns of a fourth secondary winding, second closest to the second end. The first and second windings are connected in series. The third and fourth windings are connected in series. The first and second windings are connected in parallel to the third and fourth windings. A total of the first and second numbers is equal to that of the third and fourth numbers.

3 Claims, 8 Drawing Sheets

(56) References Cited

U.S. PATENT DOCUMENTS

2017/0278622 A1* 9/2017 Chen ..... H01F 27/29

* cited by examiner

TRANSFORMER

CROSS-REFERENCE TO RELATED APPLICATION

The present application is based on and claims the benefit of priority of Japanese Priority Application No. 2017-207291 filed on Oct. 26, 2017, the entire contents of which are hereby incorporated by reference.

BACKGROUND OF THE INVENTION

1. Field of the Invention

The present invention relates to a transformer.

2. Description of the Related Art

Conventionally, there exists a transformer that includes a core, primary windings made of winding bodies wound around the core, and secondary windings made of metal plate materials (for example, see Patent Document 1). In the transformer, on the metal plate materials, through holes into which the core is inserted and that hold the core are provided, and pairs of terminals are formed. In the transformer, with respect to the core, the winding bodies and the metal plate materials are arranged alternately.

Related-Art Documents

Patent Document

[Patent Document 1] Japanese Laid-open Patent Publication No. 2006-013094

In such a conventional transformer, the numbers of turns of all the secondary windings are equal to each other, and are all one. In a case where a plurality of primary windings and a plurality of secondary windings are alternately arranged, a central part and end parts in the arrangement direction differ in leakage inductances between the primary windings and the secondary windings.

If there is a distribution (unbalance) of such leakage inductances, a distribution occurs in electric currents that flow through the plurality of primary windings. As a result, there is a possibility that a copper loss increases, a heat distribution occurs, and the upper limit temperature of the transformer is partially exceeded.

Hence, an object is to provide a transformer in which a distribution of leakage inductances is suppressed.

SUMMARY OF THE INVENTION

According to an embodiment, a transformer includes: a core having a winding shaft; N primary windings that are arranged to be wound around the winding shaft where N is an integer that is greater than or equal to 3; and N+1 secondary windings that are arranged to be wound around the winding shaft alternately with the N primary windings such that each of the N primary windings is interposed between two of the N+1 secondary windings. Among the N+1 secondary windings, a first number of turns of a first secondary winding, which is closest to a first end of the winding shaft, is less than a second number of turns of a second secondary winding, which is second closest to the first end of the winding shaft. Among the N+1 secondary windings, a third number of turns of a third secondary winding, which is closest to a second end of the winding shaft, is less than a fourth number of turns of a fourth secondary winding, which is second closest to the second end of the winding shaft. The first secondary winding and the second secondary winding are connected in series, and the third secondary winding and the fourth secondary winding are connected in series. The first secondary winding and the second secondary winding are connected in parallel to the third secondary winding and the fourth secondary winding. A total number of turns of the first number of turns and the second number of turns is equal to a total number of turns of the third number of turns and the fourth number of turns.

According to an embodiment, it is possible to provide a transformer in which a distribution of leakage inductances is suppressed.

DETAILED DESCRIPTION OF THE EMBODIMENTS

Hereinafter, transformers according to an embodiment the present invention will be described.

Embodiment

Figure 1:
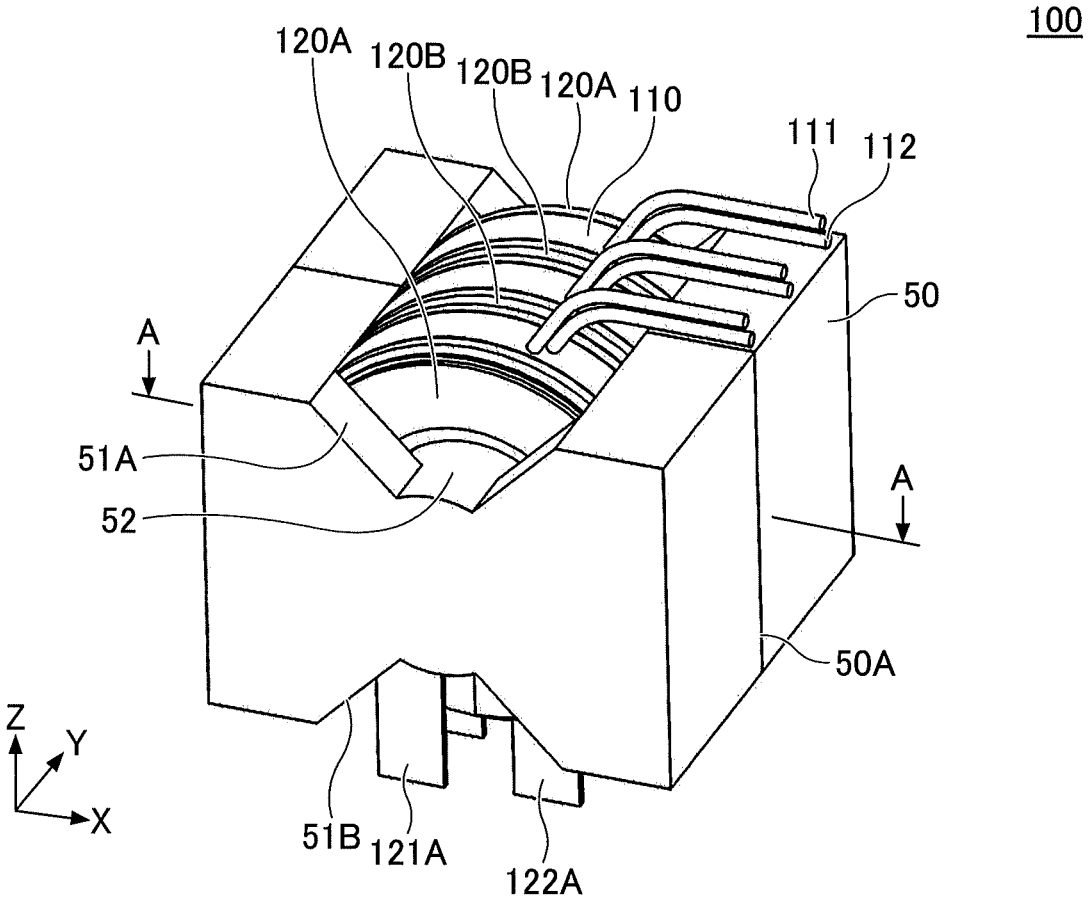
FIG. 1 is a diagram illustrating a transformer 100 according to an embodiment.
Figure 2:
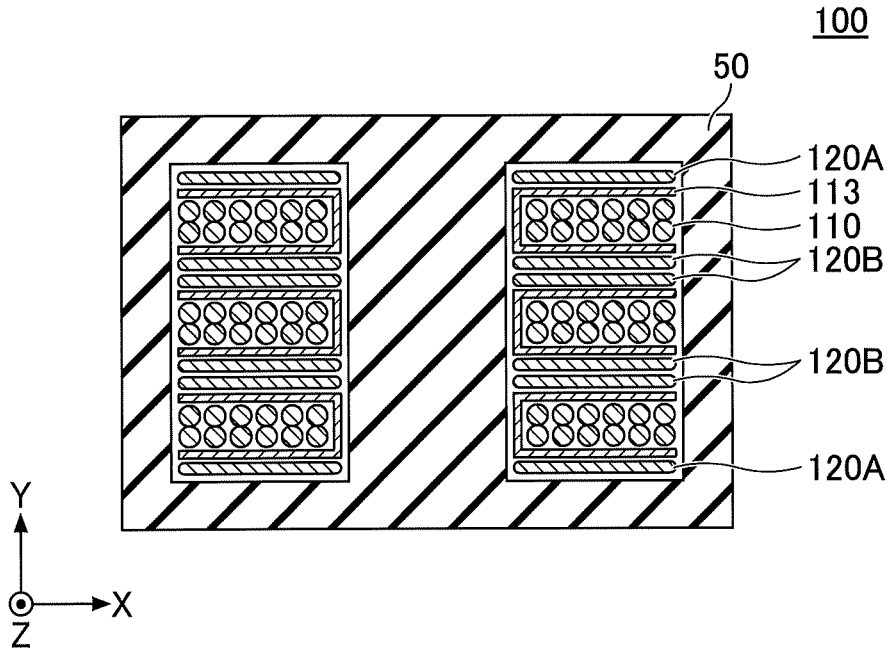
FIG. 2 is a diagram illustrating the transformer 100 according to the embodiment.
Figure 3:
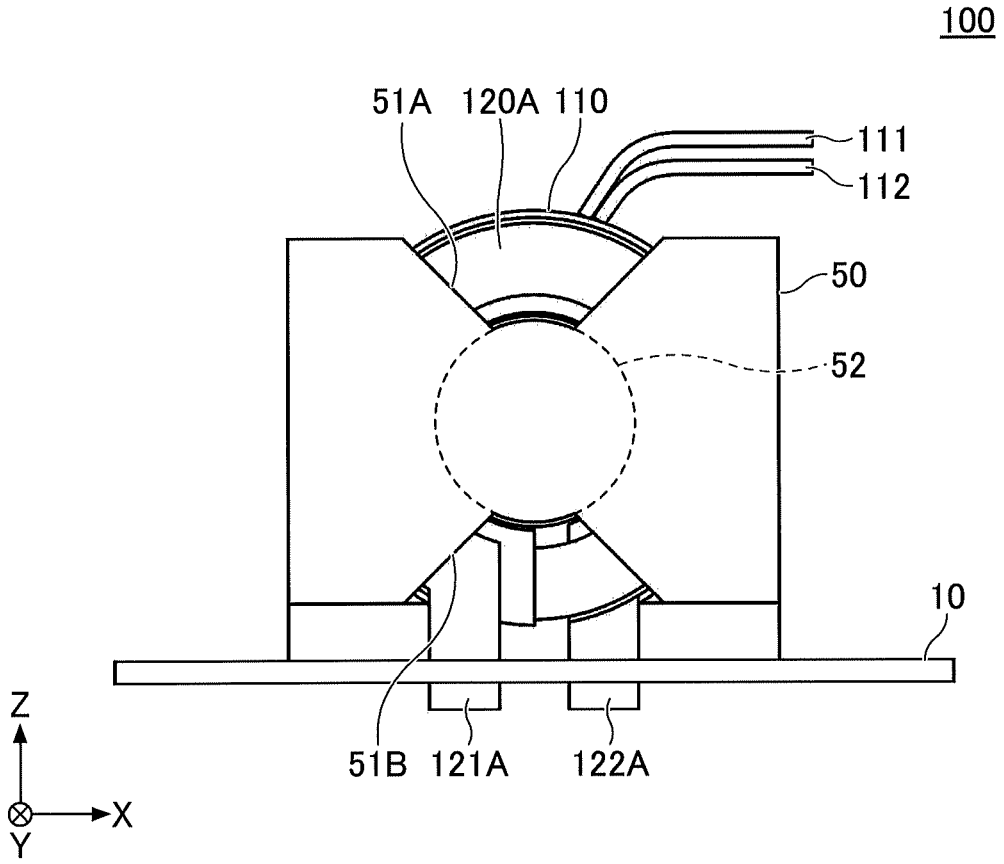
FIG. 3 is a diagram illustrating the transformer 100 according to the embodiment.
Figure 4:
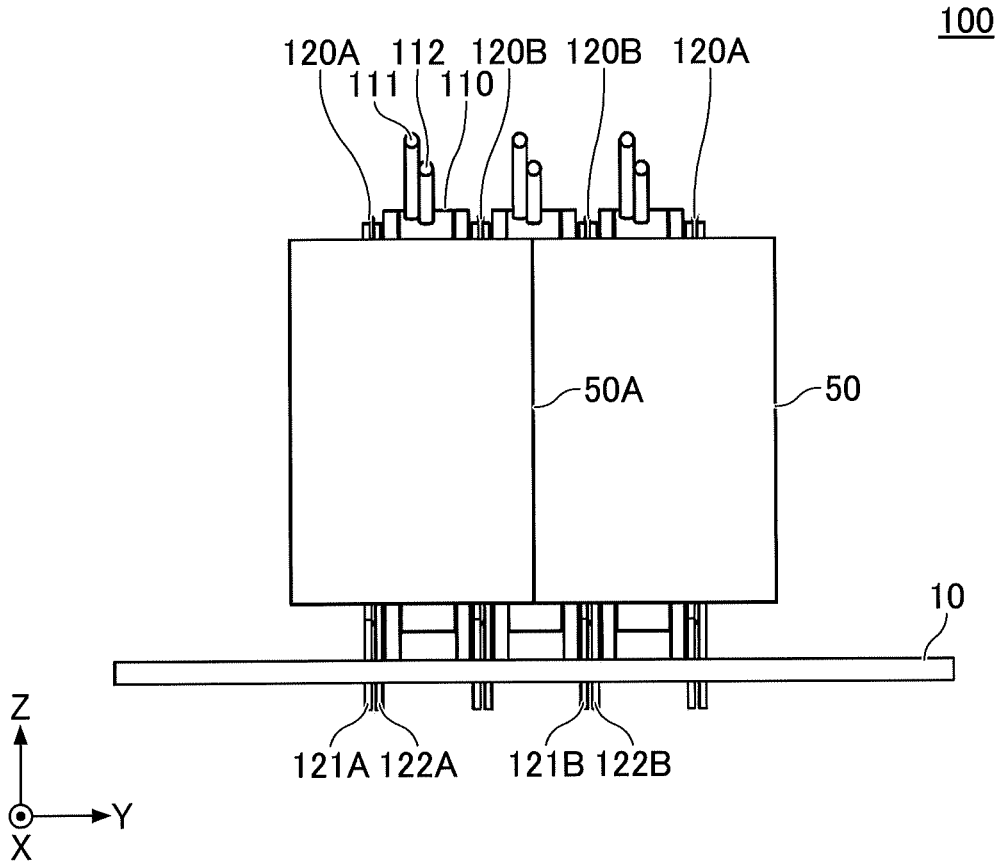
FIG. 4 is a diagram illustrating the transformer 100 according to the embodiment.

FIG. 1 to FIG. 4 are diagrams illustrating a transformer 100 according to the embodiment. FIG. 1 is a perspective view of the transformer 100, FIG. 2 is a cross-sectional view of the transformer 100 taken along line A-A of FIG. 1, and FIGS. 3 and 4 are side views of the transformer 100. Note that, in the following, an XYZ coordinate system is used for the description.

The transformer 100 includes a core 50, primary windings 110, and secondary windings 120A and 120B. FIG. and FIG. 4 illustrate a substrate 10 on which the transformer 100 is installed. The substrate 10 is, for example, a wiring substrate of FR-4 (Flame Retardant type 4) standard, and includes a plurality of wiring layers (conductive layers).

The core 50 is made of a magnetic material such as ferrite, for example, and includes a main unit 51 and a winding shaft 52. The core 50 holds the primary windings 110 and the secondary windings 120A and 120B.

The main unit 51 has a rectangular parallelepiped outer shape and has cutout portions 51A and 51B at the positive side in the Z axis direction and at the negative side in the Z axis direction. From the cutout portions 51A and 51B, parts of the primary winding 110 and the secondary windings 120A and 120B are exposed.

The winding shaft 52 is a columnar-shaped member extending in the Y axis direction at a central portion of the main unit 51 of the XZ plane. The winding shaft 52 is integrated with the main unit 51.

Because the core 50 as described above is composed of two members divided into two at the positive side in the Y axis direction and the negative side in the Y axis direction, the main unit 51 and the winding shaft 52 are divided into two at the positive side in the Y axis direction and the negative side in the Y axis direction. The two members are engaged along a joint 50A.

Each of the primary windings 110 includes end portions 111 and 112 and has a configuration obtained by winding a conductive wire. The conductive wires are made of copper, for example. The primary windings 110 are wound around annular bobbins 113. FIG. 1 to FIG. 4 illustrate, as an example, a configuration in which the transformer 100 includes three primary windings 110. Electric power at higher voltage and at lower current is supplied from an external circuit to the primary windings 110 than that to the secondary windings 120A and 120B.

The secondary windings 120A and 120B respectively include terminals 121A and 121B and terminals 122A and 122B, and each have a configuration obtained by spirally winding a metal plate. The metal plates are made of copper, for example. FIG. 1 to FIG. 4 illustrate, as an example, a configuration in which the transformer 100 includes two secondary windings 120A and two secondary windings 120B. That is, the total number of secondary windings 120A and 120B included in the transformer 100 is four.

The four secondary windings 120A and 120B are wound around the winding shaft 52 in the arrangement order of the secondary windings 120A, 120B, 120B, and 120A in the Y axis direction. The secondary windings 120A, 120B, 120B, and 120A are wound around the winding shaft 52 in a state of being alternately arranged with the three primary windings 110.

That is, the secondary windings 120A and 120B are arranged at both sides of the primary winding 110, which is located at the negative side in the Y axis direction, the secondary windings 120B and 120B are arranged at both sides of the primary winding 110, which is located at the center in the Y axis direction, and the secondary windings 120B and 120A are arranged at both sides of the primary winding 110, which is located at the positive side in the Y axis direction.

The number of turns of the secondary windings 120A is one and the number of turns of the secondary windings 120B is two. In this way, by arranging the four secondary windings 120A, 120B, 120B and 120A alternately with the three primary windings 110, arranging the two secondary windings 120B having a larger number of turns at the center side, and arranging the two secondary windings 120A having a fewer number of turns at both ends, the distribution (unbalance) of leakage inductances is suppressed. This detailed reason will be described later below.

Figure 5:
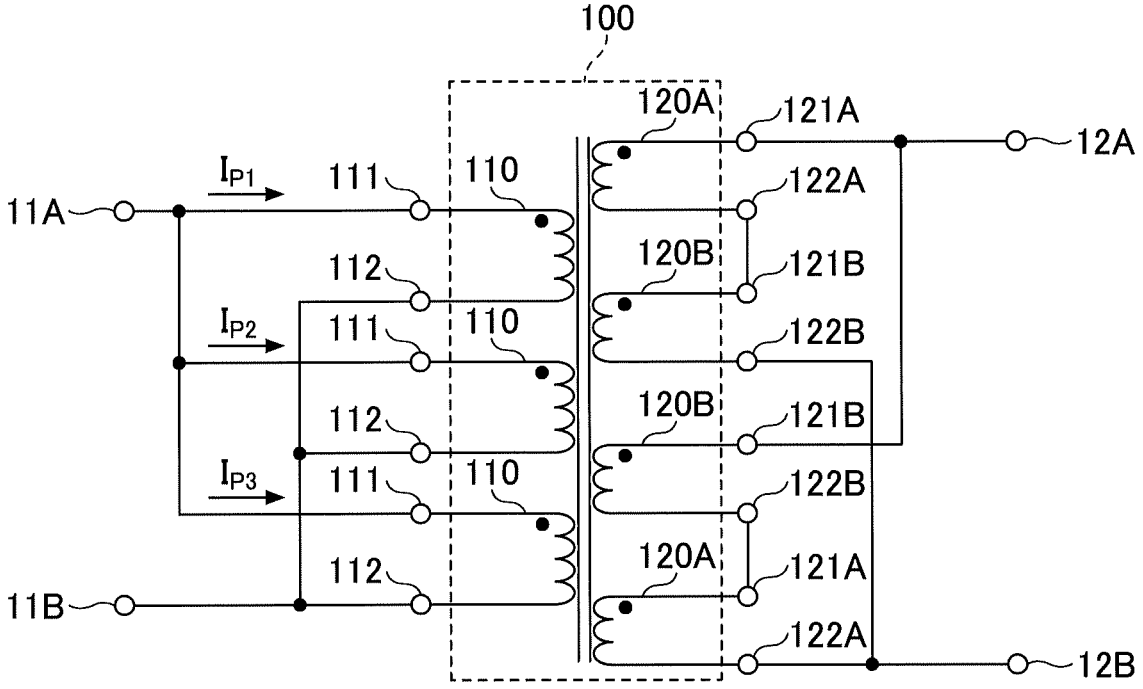
FIG. 5 is a circuit diagram illustrating a connection relationship between primary windings 110 and secondary windings 120A and 120B.

FIG. 5 is a circuit diagram illustrating a connection relationship between the primary windings 110 and the secondary windings 120A and 120B. In FIG. 5, the portion surrounded by the broken line is the transformer 100. Here, the secondary winding 120A located at the uppermost position in FIG. 5 is an example of a first secondary winding, and the secondary winding 120B located at the second uppermost position in FIG. 5 is an example of a second secondary winding. Further, the secondary winding 120A located at the lowermost position in FIG. 5 is an example of a third secondary winding, and the secondary winding 120B located at the second lowermost position in FIG. 5 is a fourth secondary winding.

The three primary windings 110 are of the same polarity and connected in parallel. Terminals 11A and 11B are connected to both ends of the three primary windings 110 connected in parallel. The terminals 11A and 11B are provided on the substrate 10 (see FIGS. 3 and 4).

In the four secondary windings 120A and 120B, one secondary winding 120A and one secondary winding 120B are of the same polarity and connected in series such that the two sets of series-connected secondary windings 120A and 120B are connected in parallel. By connecting the four secondary windings 120A and 120B in this way, the output voltages of the two sets of secondary windings 120A and 120B are matched. Terminals 12A and 12B are connected to both ends of the two sets of secondary windings 120A and 120B. The terminals 12A and 12B are provided on the substrate 10 (see FIGS. 3 and 4).

Such a connection of the four secondary windings 120A and 120B is realized by connecting the terminals 121A, 121B, 122A, and 122B to a conductive layer of the substrate 10.

Figure 6A:
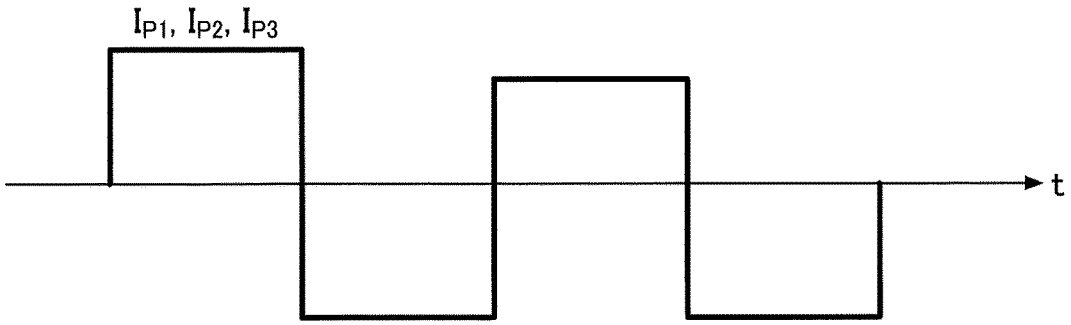
FIGS. 6A and 6B are diagrams illustrating waveforms of electric currents flowing through three primary windings 110.
Figure 6B:
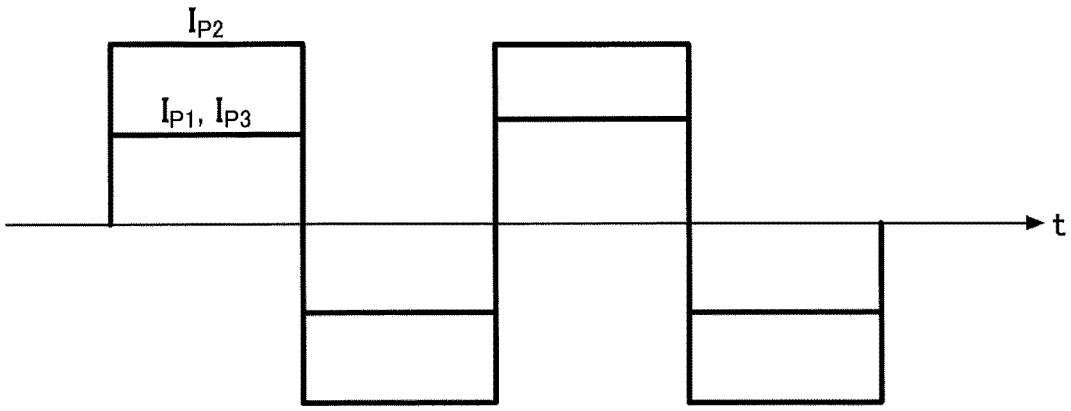

FIGS. 6A and 6B are diagrams illustrating waveforms of electric currents that flow through three primary windings 110. Here, the electric current of the primary winding 110 at the upper side in FIG. 5 is $I_{P1}$, the electric current of the primary winding 110 at the center in FIG. 5 is $I_{P2}$, and the electric current of the primary winding 110 at the lower side in FIG. 5 is $I_{P3}$.

FIG. 6A indicates electric currents $I_{P1}$, $I_{P2}$, and $I_{P3}$ in a state where the distribution (unbalance) of leakage inductances between the three primary windings 110 and the four secondary windings 120A and 120B is suppressed.

FIG. 6B indicates electric currents $I_{P1}$, $I_{P2}$, and $I_{P3}$ of three primary windings 110 of a comparative transformer. The comparative transformer has a configuration in which three primary windings 110 and two secondary windings are alternately wound around a winding shaft 52, where the two secondary windings have the same number of turns. In the comparative transformer, the number of turns of the secondary windings is, for example, three.

In the comparative transformer, the distribution (unbalance) of the leakage inductances is not suppressed, and the leakage inductance in two primary windings 110 at both sides of the three primary windings 110 is higher than the leakage inductance in one primary winding 110 at the center.

As illustrated in FIG. 6A, in the transformer 100, in the transformer 100, because the distribution (unbalance) of the leakage inductances is suppressed and equalized, the current values of the electric currents $I_{P1}$, $I_{P2}$, and $I_{P3}$ are substantially equal.

In contrast, as illustrated in FIG. 6B, in the comparative transformer, because the distribution (unbalance) of the leakage inductances is not suppressed, the current values of the electric currents $I_{P1}$ and $I_{P3}$ flowing through the two primary windings 110 located at outer sides (both sides) and having a relatively large leakage inductance are smaller than the current value of the electric current $I_{P2}$ flowing through the primary winding 110 located at the center.

As described above, in the comparative transformer, the currents $I_{P1}$, $I_{P2}$, and $I_{P3}$ at the primary side are unbalanced, which leads to an increase in copper loss and causes a heat distribution and a partial temperature rise.

In the transformer 100 according to the embodiment, in order to suppress such a distribution (unbalance) of leakage inductances, the four secondary windings 120A, 120B, 120B, and 120A are arranged alternately with the three primary windings 110, and the two secondary windings 120B having a larger number of turns are arranged at the center side and the two secondary windings 120A having a fewer number of turns are arranged at both ends. Such an arrangement is adopted for the following reason.

As in the comparative transformer, in a case where two secondary windings having an equal number of turns and three primary windings 110 are alternately wound around the winding shaft 52, when the secondary side is viewed from the primary side of the comparative transformer, the secondary windings are present at both sides with respect to the primary winding 110 located at the center among the three primary windings 110. Therefore, between the primary winding 110 at the center and the secondary windings, the magnetic coupling is tight and the leakage inductance is relatively small.

In contrast, with respect to each of the primary windings 110 at both ends, the secondary winding is present at only one side. Therefore, between the primary windings 110 at both ends and the secondary windings, the magnetic coupling is loose and the leakage inductance is relatively large, as compared with those between the primary winding 110 at the center and the secondary windings.

Such a distribution (unbalance) of the leakage inductances causes an imbalance of electric currents as illustrated in FIG. 6B, leads to an increase in copper loss at the primary side, and causes a heat distribution and a partial temperature rise.

Hence, in order to suppress a distribution (unbalance) of leakage inductances and to suppress occurrences of a copper loss, a heat distribution, and a partial temperature rise, the three primary windings 110 and the four secondary windings 120A, 120B, 120B, and 120A are alternately arranged as described above.

When the three primary windings 110 are arranged, because the primary windings 110 are present at both sides of the primary winding 110 at the center, the number of turns of the two secondary windings 120B, between which the primary winding 110 at the center is interposed, is made to be greater than the number of turns of the two secondary windings 120A at both end sides.

With respect to each of the primary windings 110 at both sides, the secondary winding 120B, whose number of turns is two, is arranged at the center side and the secondary winding 120A, whose number of turns is one, is arranged at the outer side. In this way, the magnetic coupling between each primary winding and the secondary windings is made substantially equal in order to equalize the leakage inductances.

In this way, by providing the four secondary windings 120A, 120B, 120B, and 120A and the three primary windings 110 (by making the number of secondary windings 120 greater than by one the number of primary windings 110), making the distribution of numbers of turns larger at the center side and fewer at the both outer sides such that the numbers of turns of the secondary windings 120A, 120B, and 120B, and 120A are respectively 1, 2, 2, and 1, the distribution (unbalance) of the leakage inductances is suppressed.

Also, when the number of the secondary windings 120A and 120B is an even number, the secondary windings 120A and 120B can be symmetrically arranged with respect to the primary winding 110 located at the center among an odd number of primary windings 110. Therefore, the distribution (unbalance) of the leakage inductances can be suppressed more effectively.

Note that by making the secondary windings 120A and 120B in series one by one, and by making the two sets of series-connected secondary windings 120A and 120B in parallel, an output voltage the same as that of the secondary side of the comparative transformer is obtained.

As described above, according to the embodiment, it is possible to provide the transformer 100 in which that the distribution (unbalance) of the leakage inductances are suppressed.

Further, because the terminals 121A, 122A, 121B, and 122B of the secondary windings 120A and 120B of a large amount of current are connected via the conductive layer of the substrate 10, heat can be dissipated via the conductive layer of the substrate 10.

Note that although the embodiment has been described above in which the terminals 121A, 121B, 122A, and 122B of the four secondary windings 120A and 120B are connected to the conductive layer of the substrate 10, the terminals 121A, 121B, 122A, and 122B may be connected not by the substrate 10 but by an electric power cable.

Although the embodiment has been described in which the transformer 100 includes the three primary windings 110 and the four secondary windings 120A and 120B, the numbers of the primary windings 110 and the secondary windings 120A and 120B are not limited to such numbers. The number of the secondary windings 120A and 120B may be greater than that of the primary winding 110 by one.

Further, although it has been described that the distribution (unbalance) of the leakage inductances can be suppressed more effectively when the number of secondary windings 120A and 120B is an even number, the number of secondary windings 120A and 120B may be an odd number.

Figure 7:
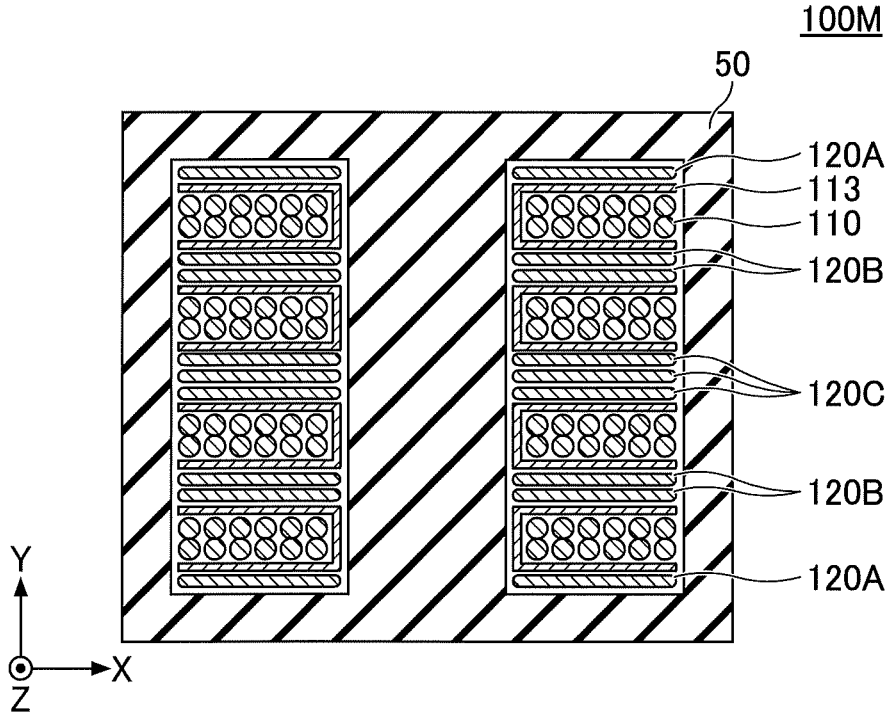
FIG. 7 is a diagram illustrating a transformer 100M according to a variation example of the embodiment.

FIG. 7 is a diagram illustrating a transformer 100M according to a variation example of the embodiment. The transformer 100M includes four primary windings 110 and five secondary windings 120A, 120B, 120C, 120B, and 120A. Other configurations of the transformer 100M are similar to those of the transformer 100 that is illustrated in FIGS. 1 to 5.

In the transformer 100M, the four primary windings 110 and the five secondary windings 120A, 120B, 120C, 120B, and 120A are wound around the winding shaft 52 in a state of being arranged alternately. The number of turns of the secondary winding 120C, which is arranged at the center of the secondary side, is 3.

Figure 8:
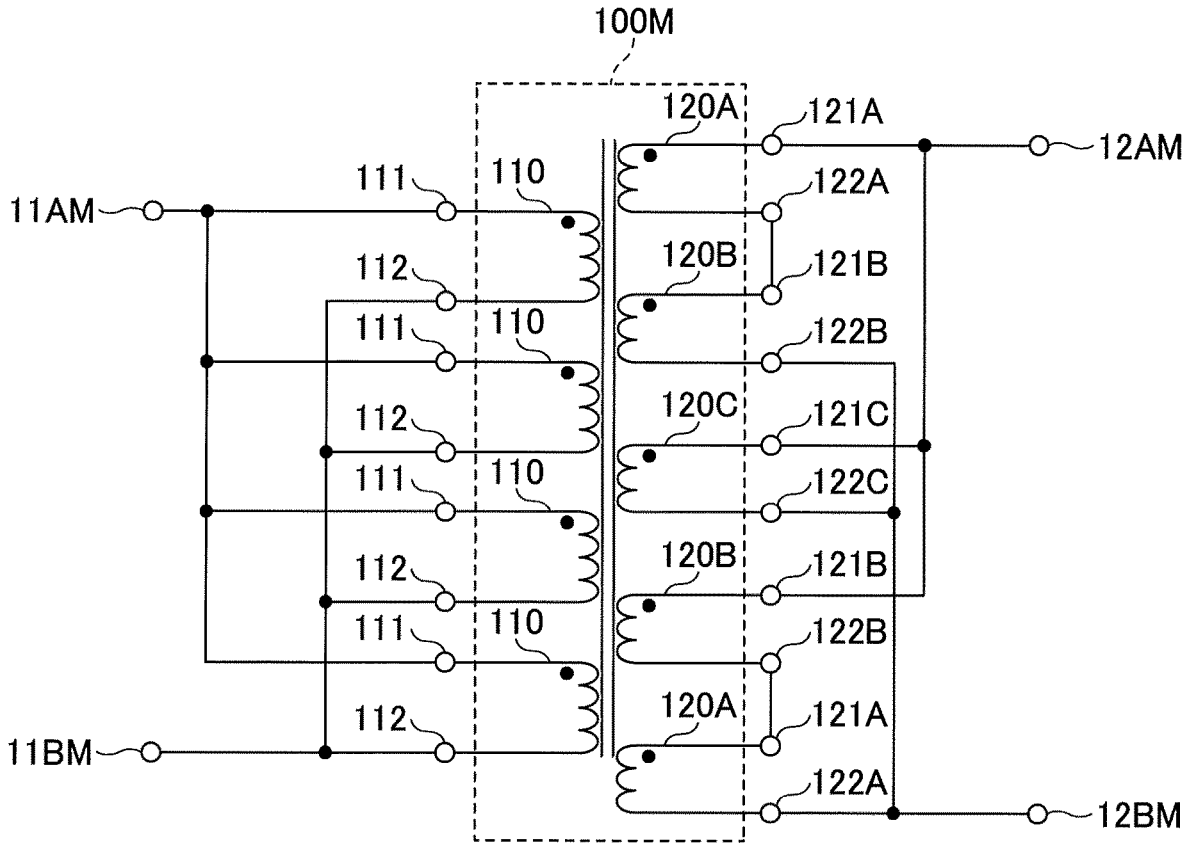
FIG. 8 is a circuit diagram illustrating a connection relationship between primary windings 110 and five secondary windings 120A, 120B, and 120C in the transformer 100M.

FIG. 8 is a circuit diagram illustrating a connection relationship between the primary windings 110 and the five secondary windings 120A, 120B, and 120C in the transformer 100M. In FIG. 8, the portion surrounded by the broken line is the transformer 100M.

The primary side has a configuration in which end portions 111 and 112 of the four primary windings 110 are of the same polarity and connected, and terminals 11AM and 11BM are connected to both ends of the four primary windings 110. The terminals 11AM and 11BM are provided on the substrate 10 (see FIGS. 3 and 4).

The secondary side has a configuration in which two sets of series-connected secondary windings 120A and 120B are connected in parallel with the secondary winding 120C, and terminals 12AM and 12BM are connected to both ends of the two sets of secondary windings 120A and 120B and the secondary winding 120C. The terminals 12AM and 12BM are provided on the substrate 10 (see FIGS. 3 and 4).

In the transformer 100M having such a configuration, the distribution (unbalance) of the leakage inductances can also be suppressed similarly to the transformer 100 according to the embodiment.

Note that although the transformer 100M has been described with reference to FIG. 7 and FIG. 8 that includes the four primary windings 110 and the five secondary windings 120A, 120B, and 120C, the numbers of primary windings 110 and secondary windings 120A, 120B, and 120C are not limited to such numbers. The number of secondary windings 120A, 120B, and 120 C may be an odd number that is greater than by one an even number of primary windings 110.

In a case of further increasing the numbers, the number of parallel-connected primary windings 110 may be increased for the primary side, and the number of secondary windings 120C provided at the center side may be increased for the secondary side. That is, series-connected secondary windings 120A and 120B may be arranged at both end sides.

As described above, an embodiment of the present invention may provide a transformer including a core having a winding shaft; N primary windings that are arranged to be wound around the winding shaft where N is an integer that is greater than or equal to 3; and N+1 secondary windings that are arranged to be wound around the winding shaft alternately with the N primary windings such that each of the N primary windings is interposed between two of the N+1 secondary windings.

Among the N+1 secondary windings, a first number of turns of a first secondary winding, which is closest to a first end of the winding shaft, is less than a second number of turns of a second secondary winding, which is second closest to the first end of the winding shaft. Among the N+1 secondary windings, a third number of turns of a third secondary winding, which is closest to a second end of the winding shaft, is less than a fourth number of turns of a fourth secondary winding, which is second closest to the second end of the winding shaft.

The first secondary winding and the second secondary winding are connected in series, and the third secondary winding and the fourth secondary winding are connected in series, the first secondary winding and the second secondary winding are connected in parallel to the third secondary winding and the fourth secondary winding, and a total number of turns of the first number of turns and the second number of turns is equal to a total number of turns of the third number of turns and the fourth number of turns.

The first number of turns is equal to the third number of turns, and the second number of turns is equal to the fourth number of turns.

Here, N+1 is 2M where M is different from N and is an integer greater than or equal to 2, and N is 2M−1.

Although examples of transformers according to the embodiment of the present invention have been described above, the present invention is not limited to the embodiment specifically disclosed and various variations and modifications may be made without departing from the scope of claims.

What is claimed is:

1. A transformer comprising:

a core having a winding shaft;

N primary windings that are arranged to be wound around the winding shaft where N is an integer that is greater than or equal to 3; and N+1 secondary windings that are arranged to be wound around the winding shaft alternately with the N primary windings such that each of the N primary windings is interposed between two of the N+1 secondary windings, wherein, among the N+1 secondary windings, a first number of turns of a first secondary winding, which is closest to a first end of the winding shaft, is less than a second number of turns of a second secondary winding, which is second closest to the first end of the winding shaft, wherein, among the N+1 secondary windings, a third number of turns of a third secondary winding, which is closest to a second end of the winding shaft, is less than a fourth number of turns of a fourth secondary winding, which is second closest to the second end of the winding shaft, wherein the first secondary winding and the second secondary winding are connected in series, and the third secondary winding and the fourth secondary winding are connected in series, wherein the first secondary winding and the second secondary winding are connected in parallel to the third secondary winding and the fourth secondary winding, and wherein a total number of turns of the first number of turns and the second number of turns is equal to a total number of turns of the third number of turns and the fourth number of turns.

2. The transformer according to claim 1, wherein the first number of turns is equal to the third number of turns, and the second number of turns is equal to the fourth number of turns.

3. The transformer according to claim 1, wherein N+1 is 2M where M is different from N and is an integer greater than or equal to 2, and wherein N is 2M−1.

* * * * *